US010060090B2

(12) United States Patent
Wu

(10) Patent No.: US 10,060,090 B2
(45) Date of Patent: Aug. 28, 2018

(54) TYPE OF SUCTION LEG, AN OFFSHORE CAISSON AND A SIT-ON-BOTTOM OFFSHORE PLATFORM

(71) Applicant: Zhirong Wu, Beijing (CN)

(72) Inventor: Zhirong Wu, Beijing (CN)

( * ) Notice: Subject to any disclaimer, the term of this patent is extended or adjusted under 35 U.S.C. 154(b) by 0 days.

(21) Appl. No.: 14/805,357

(22) Filed: Jul. 21, 2015

(65) Prior Publication Data

US 2015/0322642 A1 Nov. 12, 2015

Related U.S. Application Data

(63) Continuation of application No. PCT/CN2014/071120, filed on Jan. 22, 2014.

(30) Foreign Application Priority Data

Jan. 22, 2013 (WO) ..... PCT/CN2013/070808

(51) Int. Cl.
*E02B 17/02* (2006.01)
*E02D 27/20* (2006.01)
(Continued)

(52) U.S. Cl.
CPC ..... *E02B 17/02* (2013.01); *B63B 35/4413* (2013.01); *B65D 88/02* (2013.01);
(Continued)

(58) Field of Classification Search
CPC combination set(s) only.
See application file for complete search history.

(56) References Cited

U.S. PATENT DOCUMENTS 3,999,395 A * 12/1976 Broms ..... E02D 27/52 405/224
4,124,989 A * 11/1978 Watson ..... E02B 17/02 405/225

(Continued)

FOREIGN PATENT DOCUMENTS

CN 200971492 Y 11/2007
CN 101255701 A 9/2008
CN 102756793 A 10/2012

OTHER PUBLICATIONS

Wu, Zhirong; "Concept Introduction of Offshore Liquid Cargo Reservoir with Function of Breakwater and Berths " Proceedings I of 2013 China International Pipeline Conference, Dec. 31, 2013, 5 pages.

(Continued)

*Primary Examiner* — Kyle Armstrong
(74) *Attorney, Agent, or Firm* — Norton Rose Fulbright US LLP

(57) ABSTRACT

This application discloses a new type of suction leg, an offshore caisson, a sit-on-bottom supporting platform. The suction leg includes a sealing long pile, this sealing long pile including a tubular pipe and a top head connected tightly to the tubular pipe to form cylindrical integral structure with sealing top and opening bottom. The top head has at least one opening to be able to open or close. The sealing long pile can be penetrated into the seabed by a gravity penetration method or/and a suction pile penetration method, or pulled out from the seabed by a buoyancy uplift method or/and a suction pile uplift method.

14 Claims, 6 Drawing Sheets

(51) Int. Cl.

| | |
|---|---|
| ***E02D 23/02*** | (2006.01) |
| ***E02D 23/10*** | (2006.01) |
| ***E02D 25/00*** | (2006.01) |
| ***E02D 27/18*** | (2006.01) |
| ***E02D 27/52*** | (2006.01) |
| ***E02D 29/09*** | (2006.01) |
| ***E04H 7/02*** | (2006.01) |
| ***B63B 35/44*** | (2006.01) |
| ***E02B 17/06*** | (2006.01) |
| ***B65D 88/02*** | (2006.01) |
| ***E04H 7/04*** | (2006.01) |
| ***E04H 7/18*** | (2006.01) |
| ***E02B 17/00*** | (2006.01) |
| ***E02D 27/12*** | (2006.01) |
| ***E02D 27/38*** | (2006.01) |
| ***E02D 29/00*** | (2006.01) |
| *B65D 88/78* | (2006.01) |

(52) U.S. Cl.

CPC ..... *E02B 17/0017* (2013.01); *E02B 17/025* (2013.01); *E02B 17/027* (2013.01); *E02B 17/06* (2013.01); *E02D 23/02* (2013.01); *E02D 23/10* (2013.01); *E02D 25/00* (2013.01); *E02D 27/12* (2013.01); *E02D 27/18* (2013.01); *E02D 27/20* (2013.01); *E02D 27/38* (2013.01); *E02D 27/52* (2013.01); *E02D 27/525* (2013.01); *E02D 29/00* (2013.01); *E02D 29/06* (2013.01); *E04H 7/02* (2013.01); *E04H 7/04* (2013.01); *E04H 7/18* (2013.01); *B63B 35/44* (2013.01); *B63B 2035/442* (2013.01); *B63B 2035/448* (2013.01); *B65D 88/78* (2013.01); *E02B 2017/0039* (2013.01); *E02B 2017/0043* (2013.01); *E02B 2017/0056* (2013.01); *E02B 2017/0069* (2013.01); *F17C 2201/0104* (2013.01); *F17C 2201/054* (2013.01); *F17C 2203/0341* (2013.01); *F17C 2203/0362* (2013.01); *F17C 2203/0379* (2013.01); *F17C 2203/0631* (2013.01); *F17C 2203/0639* (2013.01); *F17C 2203/0678* (2013.01); *F17C 2205/0111* (2013.01); *F17C 2221/033* (2013.01); *F17C 2221/035* (2013.01); *F17C 2223/0153* (2013.01); *F17C 2223/0161* (2013.01); *F17C 2223/033* (2013.01)

(56) References Cited

U.S. PATENT DOCUMENTS

| | | | | |
|---|---|---|---|---|
| 4,428,702 | A | 1/1984 | Abbott et al. | |
| 4,733,993 | A * | 3/1988 | Andreasson ..... | B63B 21/26 114/296 |
| 2011/0013989 | A1* | 1/2011 | Wu ..... | B65D 88/78 405/210 |
| 2012/0003048 | A1* | 1/2012 | Hosoy ..... | B63B 21/27 405/172 |

OTHER PUBLICATIONS

International Search Report issued for PCT/CN2014/071120, dated Apr. 25, 2015, 5 pages.

* cited by examiner

TYPE OF SUCTION LEG, AN OFFSHORE CAISSON AND A SIT-ON-BOTTOM OFFSHORE PLATFORM

CROSS-REFERENCE TO RELATED APPLICATIONS

This application is a continuation of International Application Serial No. PCT/CN2014/071120 entitled "Suction-Type Pile Leg, Offshore Caisson, and Seabed-Fixed Offshore Platform," filed on Jan. 22, 2014, which claims priority from International Application Serial No. PCT/CN2013/070808 entitled "Unitary Barrel of Steel Plate and Concrete Composite Structure, Unitary Group Barrel, and Offshore Platform," filed on Jan. 22, 2013. All of the above-identified applications are incorporated herein by reference in their entirety.

BACKGROUND

Field of the Invention

This invention relates to a new type of suction leg which is used as foundation of offshore caissons or platforms.

Background of the Invention

Currently, the most common foundations of an offshore fixed structure have following four types.

1. Self-elevating platform leg bearing loads after inserted into seabed, which is widely used and includes steel tube friction leg (rarely used now) and boot leg, and the boot leg rely on its pile shoe to bear loads. The biggest advantage of the self-elevating platform is that it does not need any offshore construction facility such as floating crane during offshore installation and the relocation process besides tugs, that is to say the self-elevating platform can achieve self-installation and self-relocation. However, the disadvantage is the depth of the leg inserted into mud is shallow, usually less than 20 meters, which is due to a large resistance of each pile shoe into mud, and a limited volume of the water ballast tank on the platform deck to offer a smaller weight required for the leg inserted into mud. Therefore, the bearing capacity of the self-elevating platform leg, especially the horizontal bearing capacity is limited. When the self-elevating platform serves as a production platform and is located at a same position without moving and relocation for several or a dozen years, it must be designed as per decades or one hundred years environmental conditions, which is a big challenge to ensure the leg's bearing capacity.

2. Open long pile, which is a two-end-opening steel or reinforced concrete long pipe, so called as open pile. The open long pile, such as a steel pile of a jacket platform, inserted into a pile sleeve of the offshore structure is driven into a seabed by a pile hammer and then fixed to the pile sleeve. Due to the limited capability of the pile hammer, the diameter of the open long pile is usually not more than 2.5 meters, and the length in mud is usually not more than 90 meters. The open long pile relies on the lateral friction force between the pile and the soil and the tip resistance after soil-consolidation to bear the vertical load, so the open long pile is usually called as friction pile. The main disadvantage is piling must use the pile hammer which needs a supporting offshore floating crane, and the open long pile will be difficult to pull out and reuse.

3. Suction pile, which is a bottom-opening and top-closed cylinder usually made of steel structure. During the suction or water injection processes by the special pump(s) installed on the top head of the suction pile, the downward penetration force or the upward uplifting force is produced by the pressure difference between inside and outside the top head, and the penetration force or the uplifting force would press or pull the suction pile into or out from the seabed. During penetration, the said pressure difference is determined by the water depth and difficult to increase so much, meanwhile a large external pressure may cause a buckling problem to the cylinder and its top head. Therefore, the diameter and penetrative depth of the suction pile have to be restricted, the diameter is usually 8 to 10 meters, the penetrative depth is generally not more than 12 meters, and the corresponding penetration force cannot be so large. Suction pile belongs to shallow foundation, which relies on the tip resistance, lateral earth pressure, lateral friction force and internal and external differential pressure to bear loads. The advantage of the suction pile is it can be pulled out and reused, that is to say it has recoverability. Two shortcomings of suction pile are as follows: firstly it need special pump and corresponding offshore operations supporting facilities, secondly it has high requirements on the shallow layers' bearing capacity of the seabed.

4. Gravity type foundation, which is widely used in offshore concrete gravity platforms, for example, a fixed offshore structures can stay on a seabed relied on its massive gravity. At present, offshore caissons used in ports, bridges and artificial islands also usually use gravity type foundations, supplemented by anti-sliding piles. The disadvantage of the gravity foundation is it has high requirements on the bearing capacity of the seabed and the structure is difficult to remove.

Fixed platforms for oil and gas field development in shallow waters mainly include jacket platform and gravity platform, mobile self-elevating platform, their basic structure and advantages/disadvantages are well-known and do not need to repeat. Usually, only the gravity platform has liquid storage function, and the mobile platform and the jacket platform, without storage, need to be compatible with FPSO(s) (floating production storage and offloading vessel(s)) to meet the requirement of oil drilling, oil production, storage and exportation. All of said existing facilities have high EPC investments, operating and decommissioning costs.

PCT/CN2013/070808 disclosed a type of sealing steel pile comprising a tubular pipe and a top head connected tightly to form a cylindrical integral structure with a sealing top and an opening bottom, and a release valve, an air intake valve and a water intake valve installed on the top head. As the foundation of offshore facilities, the sealing steel pile could be pressed into seabed by the weight of the facilities with ballast water, or/and by pump suctioning; and also, it could be pulled out from the seabed by the buoyancy of the facilities de-ballasted water, or/and by the method to inject water or gas into the sealing pile. PCT/CN2013/070808 gave detailed descriptions about the sealing pile pressed into or pulled out from seabed, as well as the offshore installation of the facility with sealing steel piles, and also disclosed limited information about the connection structure between the sealing steel piles and the offshore facility.

SUMMARY OF THE INVENTION

One of the purposes of this application is to provide a type of suction leg which has advantages of simple structure, large penetrative depth, high bearing capacity, small loads of penetration or pile pull-out, and easy to control.

Another of the purposes of this application is to provide a type of offshore caisson founded with the said suction legs.

Another of the purposes of this application is to provide a type of removable sit-on-bottom offshore platform founded with the said suction legs.

In order to achieve above purposes, this application discloses a suction leg, comprising a sealing long pile and a long pole. The sealing long pile comprises a tubular pipe and a top head connected tightly to form a cylindrical integral structure with a sealing top and an opening bottom. The top head has at least one opening hole to be able to open or close. The long pole is fixed in the center of the top head of the sealing ling pile and it has a common central axis with the sealing long pipe. The sealing long pile can be pressed into a seabed by gravity penetration method or/and suction pile penetration method, and be pulled out from the seabed by buoyancy uplift method or/and suction uplift method.

This application also discloses an offshore caisson, it comprises a watertight tank made of steel or reinforced concrete, at least two pile sleeves arranged symmetrically around the bottom of the said tank, and legs, i.e., the said suction legs, inserted into these pile sleeves. The watertight tank has at least one ballast compartment for adding solid ballast to increase the weight of the caisson, or for injecting/ejecting seawater to change the weight of the caisson. The watertight tank and the pile sleeves are permanently connected together to form an integral structure, each suction leg can be detachably connected to the pile sleeve.

This application also discloses a sit-on-bottom offshore platform, which includes the following components.

Storage tank(s) sit on the seabed, which is used to store the platform's output liquid(s) or receive input liquid(s). A transparent moon pool may or may not set in the tank. There are at least two pile sleeves which arranged symmetrically around the bottom parameter of the said tank to form an integral structure.

Suction legs as described above, which number is equal to the number of the pile sleeves. Each leg can have a long pole or not. The sealing long pile of each suction leg is inserted into the pile sleeve, and the long pile can slide up/down along and be fixed to the pile sleeve.

Topsides located in the top of storage tank and above water, it is connected to storage tank by deck legs or suction legs.

The sealing long piles of the suction legs are inserted downwards into the seabed to become a foundation of the sit-on-bottom offshore platform. By gravity penetration or/and suction pile penetration, or buoyancy uplift or/and suction uplift, the sit-on-bottom offshore platform can be sit on and fixed to the seabed, or re-floated and removed.

This application further discloses a suction leg including a sealing long pile with or without a long pole. The sealing long pile comprises a tubular pipe and a top head connected tightly to the tubular pipe to form a cylindrical integral structure with a sealing top and an opening bottom. The top head has at least one opening to be opened or closed. The long pole is a cylindrical or a triangle truss structure being fixed on a center of the top head of the sealing long pile and has a common axis with the sealing long pile. A diameter of the long pile is smaller than a diameter of the tubular pipe. The the sealing long pile is penetrated into a seabed by a gravity penetration method or a suction pile penetration method, or pulled out from the seabed by a buoyancy uplift method or a suction pile uplift method.

This application further discloses an offshore caisson including a watertight tank made of steel or reinforced concrete structure, the watertight tank having at least one ballast compartment used for injecting or ejecting ballast seawater and a solid ballast to change the weight of the offshore caisson, at least two pile sleeves arranged symmetrically around a bottom of the watertight tank, and a suction leg in the pile sleeves. The watertight tank and the pile sleeves are connected together to form an integral structure. The suction leg comprises a sealing long pile having a tubular pipe and a top head connected tightly to the tubular pipe to form a cylindrical integral structure with a sealing top and an opening bottom. The sealing long pile of the suction leg slips up-and-down along or is fixed with the pile sleeve. The sealing long pile serves as a foundation of the offshore caisson.

This application additionally disclose a sit-on-bottom offshore platform including a storage tank sit on a seabed for storing platform-produced liquid or receiving input liquid and with or without a transparent moon pool, at least two pile sleeves being arranged symmetrically around the bottom of the storage tank, the pile sleeves being connected to the storage tank to form an integral structure, suction legs comprise sealing long piles with or without long poles, the sealing long pile having a tubular pipe and a top head connected tightly to the tubular pipe to form a cylindrical integral structure with a sealing top and an opening bottom, the top head having an opening, a number of the suction legs being equal to a number of the pile sleeves, the sealing long piles of the suction legs being inserted into the pile sleeves, and slide up and down or are fixed to the pile sleeves, a topsides located in a top of storage tank, which is connected to the storage tank by deck legs or the long poles of the suction legs. Each suction leg is raised up at its upper position, the bottom of each sealing long pile and the storage tank are at a same horizontal plane. The opening on the top heads of the sealing long pile is closed during construction and towing. The bottom opening of each sealing long pile is submerged underwater to form a closed air inside the sealing long pile to increase the buoyancy and the GM of the sit-on-bottom platform during wet towing. The sealing long piles of the suction legs are pressed down into the seabed and become a foundation of the sit-on-bottom platform. The sit-on-bottom platform sits on seabed, or is re-floated or removed through a gravity penetration method or a suction pile penetration method, or a buoyancy uplift method or a suction pile uplift method.

Compared with existing technology, the present application has the following characteristics and advantages:

1. Compared with the existing self-elevating platform leg, the suction leg in this application has advantages of simple structure, large penetrative depth, high bearing capacity, small loads of penetration or pile pull-out, and easy to control.

2. Compared with the existing open long pile and suction pile being used as foundation of fixed offshore structures, the suction leg in this application has the advantages of both open long pile and suction pile at the same time. The offshore structures and facilities using this sealing long pile as foundation, such as offshore caissons and removable fixed offshore platforms, assisting by the gravity type foundation if necessary, can be flexibly installed on the seabed with different engineering geological conditions to save foundation cost.

3. Compared with the existing fixed offshore platform and FPSO, the removable fixed offshore platform in this application unites two of jacket and FPSO in one, with functions of drilling, oil and gas production, storage and transportation, oily water treatment, natural gas liquefaction and then gasification; it has series of advantages, such as eco-friendly, safe and reliable. Besides, all the construction and pre-commissioning work of the entire platform can be completed in a shipyard, and the platform can achieve self-installation and self-relocation and reuse, as well as significant savings in facilities construction, production operation and decommissioning.

BRIEF DESCRIPTION OF THE DRAWING

These drawings described herein are only used for the purpose of interpretation and do not intend to limit the scope of the present invention in any way. Further, in the graph shape and scale size of each component are only schematic to help understanding this invention, not specifically defined each component's shape and proportional size. Technical staff in this field under the guidance of this invention can according to specific situation choose possible options of shape and proportional size to implement this invention.

FIG. 11 is an isometric view of tank unit with steel plate and concrete composite structure for storing crude oil and the like;

Description of appended drawing reference numbers is as follow:

1. Water Surface, 2. Seebed, 10. Suction Leg, 11. Sealing Long Pile, 111. Tubular Pipe of Sealing Long Pile, 112. Top Head of Sealing Long Pile, 113. Valve, 12. Long Pole, 20. Offshore Caisson, 21. Caisson Pile Sleeve, 22. Tank Of Caisson, 221. Ballast Compartment, 23. Caisson Skirt Plate, 30. Removable Sit-On-Bottom Offshore Platform, 30*a*. Removable Sit-On-Bottom Offshore Platform and the Storage Tank with Above-Water Top, 30*b*. Removable Sit-On-Bottom Offshore Platform and the Storage Tank with Underwater Top, 31. Storage Tank Sit on Seabed (Sit-On-Bottom Storage Tank), 311. Tank Unit, 312. Top Connecting Structure, 3121. Hole for Long Pole, 313. Bottom Connecting Structure, 314. Platform Pile Sleeve, 315. Moon Pool, 32. Topsides, 321. Open Deck Structure of Topsides, 322. Box Watertight Deck Structure, 323. Deck Leg, 33. Tank Unit with Steel Plate and Concrete Composite Structure, 331. Outer Concrete Tank, 3311. Outer Tank Shell, 3312. Outer Tank Head, 3313. Ring Corbel, 332. Inner Steel Tank, 3321. Inner Tank Shell, 3322. Inner Tank Head, 3323. Cylinder Epitaxial Structure of Inner Tank, 3324. LNG Compartment Wall, 3325. Thermal Insulation, 3326. Inner Tank's Outer Steel Wall, 333. Isolation Layer, 334. Spare Compartment.

DETAILED DESCRIPTION OF THE INVENTION

Drawings and descriptions of embodiments can make the invention details clearer. However, those described embodiments are only used to explain the purpose of the invention, could not be interpreted as limiting the invention in any way. Technical staff in this field under the guidance of this invention could conceive any possible deformation based on this invention, these should be considered as belong to the scope of this invention.

Suction Leg

Figure 1:
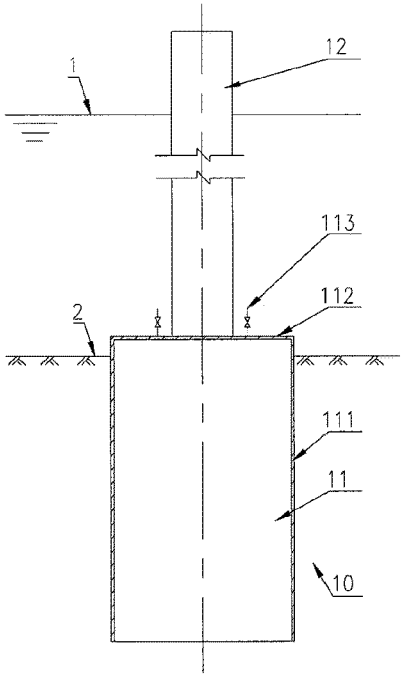
FIG. 1 is a front view of the suction leg in this invention.

As shown in FIG. 1, this embodiment discloses a new type of suction leg 10 which can be used as a foundation of a fixed offshore facility, which comprises a sealing long pile 11 to be pressed into a seabed 2 and a long pole 12. This sealing long pile 11 comprises a tubular pipe 111 and a top head 112 connected tightly to form a cylindrical integral structure with a sealing top and an opening bottom. The top head 112 has at least one opening hole to be able to open or close. This sealing long pile 11 can be penetrated into the seabed by the gravity penetration method or/and the suction pile penetration method, and be pulled out from the seabed by the buoyancy uplift method or/and the suction pile uplift method. As an option to the opening holes, a group of valves 113 are install on the top head 112 as shown in FIG. 1, which include an air release/suction valve, an air intake valve and a water intake valve, and opening or closing the opening hole can be realized through controlling the said valves. This long pole 12 is cylindrical or triangle truss structure (not shown in the figure), which scale of cross section is much smaller than the cylinder's diameter of the sealing long pile. The long pole 12 is fixed on the center of the top head 112 of the sealing long pile and has a common central axis with the sealing long pipe 11.

The sealing long pile 11 can slide up-and-down or be fixed in pile sleeve 21 (see FIGS. 2 and 3) or 314 (see FIGS. 4~10). The purpose to use long pole 12 is to benefit controlling the suction leg sliding up-and-down and connecting/auxiliary fixing. As one of the options, the suction leg 10 can have no long pole 12 and use sealing long pile 11 directly.

The sealing long pile of the suction leg in this embodiment has both advantages of the open long pile and the suction pile at the same time and does not have their disadvantages.

When the opening hole on top head 112 of suction leg 10 is opened, the sealing long pile 11 becomes an open long pile, which can be penetrated into the seabed or pulled out from the seabed rely on the weight-in-water or the buoyancy of the offshore structure. The said two methods referred to as "gravity penetration method" and "buoyancy uplift method" respectively. The existing open long pile is driven into the seabed by a pile hammer. The diameter of the open long pile is rather small. However, compared with the open long pipe, the diameter of sealing long pile 11 in this embodiment is larger and its length is longer than existing suction pile provided the weight-in-water of the offshore structure is large enough. For example, the diameter of this suction leg 10 can be more than 10 meters, and its penetrative depth is between the depths of the open long pile and the suction pile and usually 20~30 meters to meet the bearing capacity requirement. Besides, as long as the offshore structure's buoyancy is large enough after its wet weight reduced, the sealing long pile 11 can be pulled out from the seabed by the buoyancy. Method to increase/decrease the weight of the offshore structure is to inject/eject ballast seawater into/out from the ballast compartment.

When the opening hole on the top head 112 of the suction leg 10 is closed, the sealing long pile 11 becomes a suction pile, which has the following characteristics: 1) This suction leg 10, similar to existing suction pile, can be penetrated into or pulled out from the seabed by the difference of the internal and external pressures at the top head 112 during offshore installation. The pressure difference is produced by suction or injection operations of the special pump(s) installed on the top head. The said two methods referred to as "suction pile penetration method" and "section pile uplift method". 2) In in-place condition, this suction leg 10 reach the required penetrative depth as shown in FIG. 1, and its sealing long pile 11 bears loads as same as a conventional suction pile dose, including compressive resistance, uplift resistance, slip resistance and overturning resistance.

The sealing long pile 11 can be penetrated into the seabed using the two methods of gravity penetration and suction pile penetration at the same time, and be pulled out from the seabed using the two methods of buoyancy uplift and suction pile uplift at the same time. When two methods used at the same time, the opening hole on the head 112 must be closed.

The sealing long pile 11 of the suction leg 10 in this embodiment is steel structure or reinforced concrete structure, and the long pole 12 is steel structure.

The sealing long pile 11 of the suction leg 10 in this embodiment has the following advantages: good adaptability to the seabed, safety and reliability, flexible construction scheme, more convenient to installation due to the long pole 12 matched with the sealing long pile 11, project investment saving and recyclable, that creates necessary conditions for self-installation and self-removal of the offshore structure with suction legs 10.

Offshore Caisson

Figure 2:
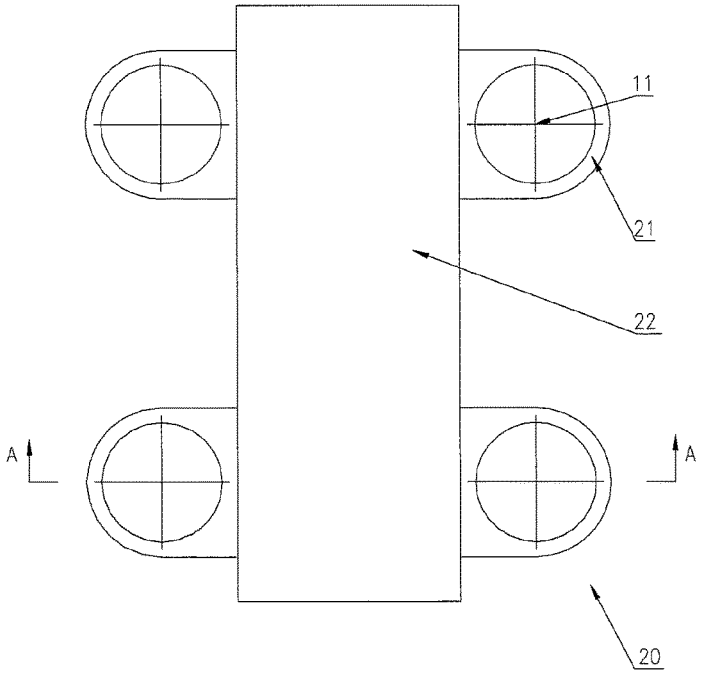
FIG. 2 is a plan view of offshore caisson.
Figure 3:
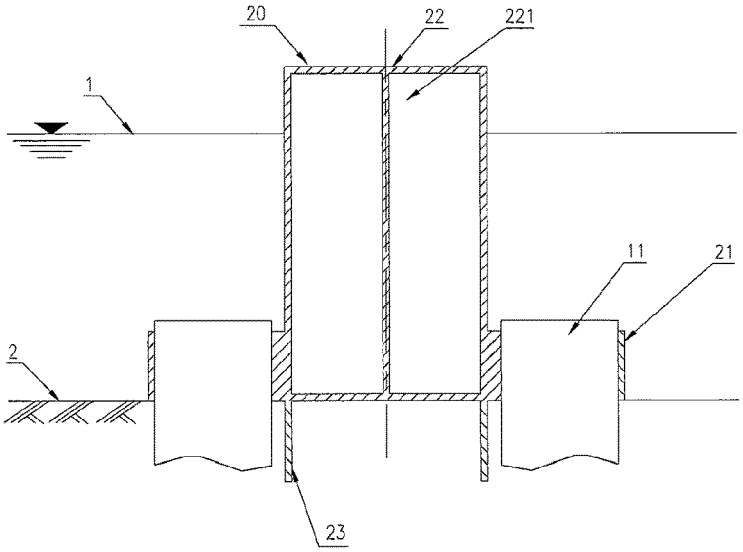
FIG. 3 is a cutaway view of FIG. 2 from A-A axis.

As an application of the suction leg 10 in the present application, as shown in FIG. 2 and FIG. 3, this embodiment provides an offshore caisson 20 used for ports, bridges and artificial island. This offshore caisson 20 is steel or reinforced concrete structure, which consists of a watertight tank 22, at least two pile sleeves 21 arranged symmetrically around the bottom of watertight tank 22. The watertight tank 22 has at least one ballast compartment 221 used for injecting/ejecting ballast seawater and also adding solid ballast such as iron ore. The sealing long pile 11 inserted in each pile sleeve 21 can slip up-and-down along the sleeve and then be fixed with the pile sleeve 21.

Similar to the existing offshore caisson, the offshore caisson in present embodiment can be built in a dry dock and transported to site by wet towing (float towing in water). The sealing long piles 11 are inserted into the pile sleeves 21, the bottoms of the sealing long piles 11 and the storage tank 22 are at the same horizontal plane and they can fixed temporarily as an integrated structure for wet towing. Gravity foundation or long pile foundation, or both two are usually used for the existing offshore caissons. The foundation of this offshore caisson 20 is the sealing long piles 11. Gravity penetration method can be used for the sealing long piles 11, that is to say, when the valves 113 of the sealing long piles 11 opened, injecting ballast seawater or adding solid ballast to the ballast compartment 221 of the offshore caisson 20 to increase the underwater weight for penetration. When the valves 113 of the sealing long piles 11 closed, the sealing long piles 11 can be penetrated into seabed and the caisson 20 sitting on the seabed (see FIG. 3) by the suction pile penetration method, or by both the gravity penetration method and the suction pile penetration method at the same time. Before using the gravity penetration method, the sealing long piles 11 need to be fixed to the offshore caisson 20, then penetrating the sealing long pile 11 by gravity; if a one-time penetrating pile cannot reach the design depth, it has to remove the fixation, discharge the ballast water, make the caisson 20 re-floating again from the seabed, and then fix and penetrate the sealing long pile 11, until it reaches the design depth. In addition, if adding solid ballast is necessary, it should ensure the offshore caisson 20 still is capable of re-floating after discharging the ballast water. If the offshore caisson 20 need to removal or decommissioning, it can use the "buoyancy uplift method" to discharge ballast water from the caisson's ballast compartment, or the "suction pile uplift method", or both two methods to achieve piles be pulled out from the seabed and the caisson floated.

The caisson 20 in this embodiment use sealing long pile 11 as foundation, at the same time, it can also use its weight as an auxiliary gravity foundation. For example, when the pile penetration is done, more solid ballast can be added into the caisson 20. Besides, there is a skirt guard plate 23 around the bottom parameter of the caisson 20 to increase the capacity of anti-sliding and anti-scour, and this skirt guard plate 23 can be penetrated into or pulled out from the seabed by the gravity or buoyancy of the caisson. The offshore caisson 20 in this embodiment can realize self-installation and entire installation procedure does not require large offshore construction facilities, which follows the steps of transporting the offshore caisson 20 with sealing long pile 11 to site by wet towing under help of the buoyancy, putting down sealing long pile 11, using "gravity penetration method" or/and "suction pile penetration method" to penetrate the sealing long pile 11 into the seabed and making offshore caisson 20 sit on the seabed. The steps to remove or relocate the caisson 20 without large offshore construction facilities are as follows: using the "buoyancy uplift method" or/and the "suction pile uplift method" to pull out pile from seabed and making the caisson refloated and removed.

Sit-On-Bottom Offshore Platform

Figure 4:
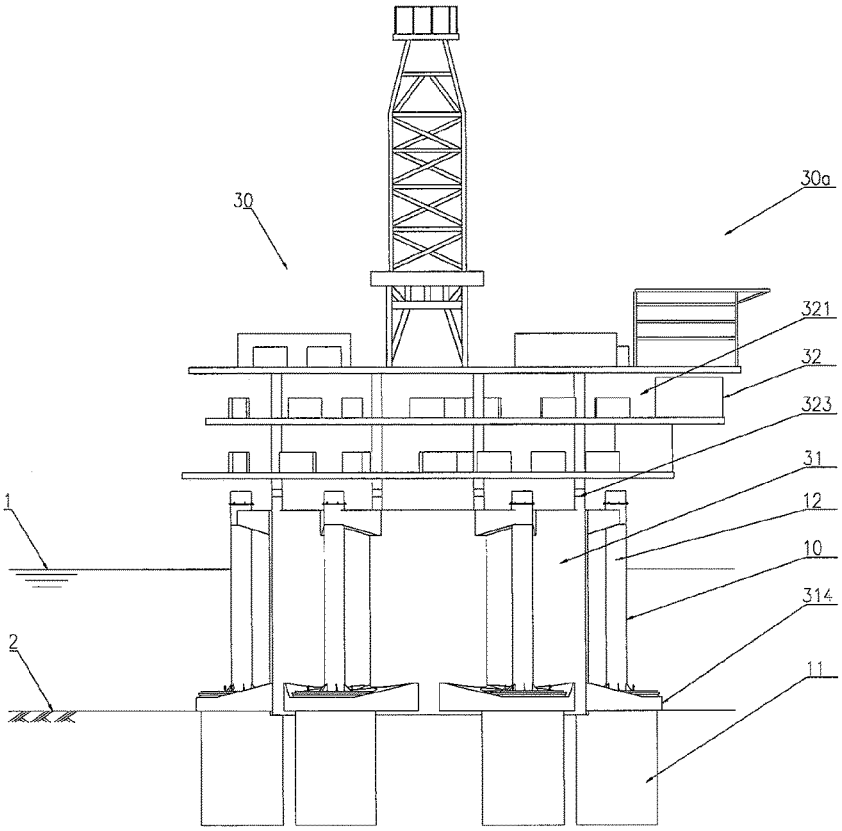
FIG. 4 is a front view of implementation plan A, a removable sit-on-bottom offshore platform which has a storage tank with above-water top in in-place condition.
Figure 5:
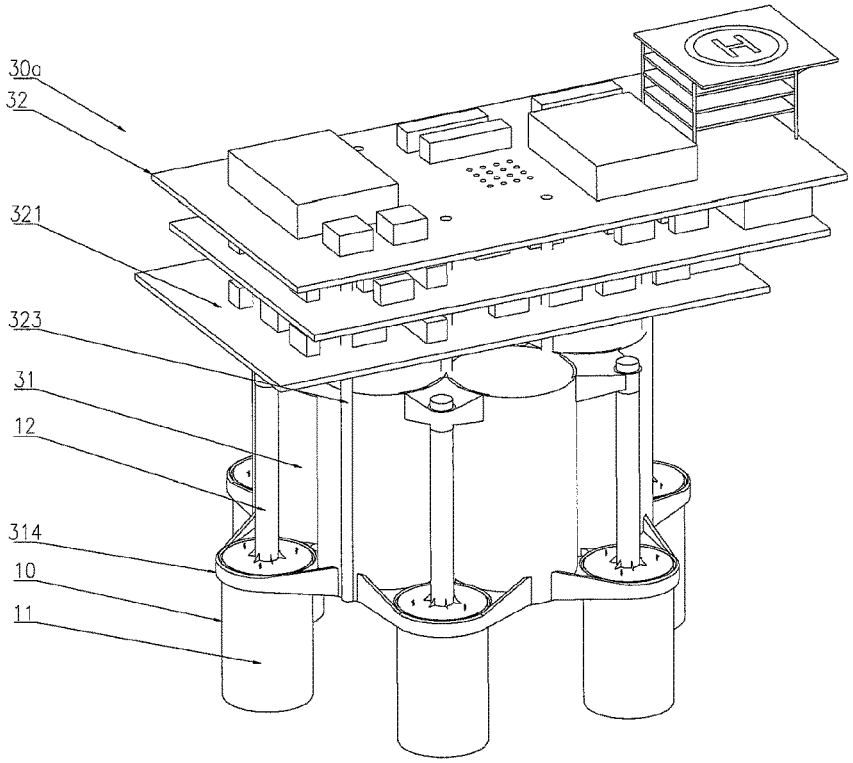
FIG. 5 is an isometric view of implementation plan A, a removable sit-on-bottom offshore platform which has a storage tank with above-water top in in-place condition.
Figure 6:
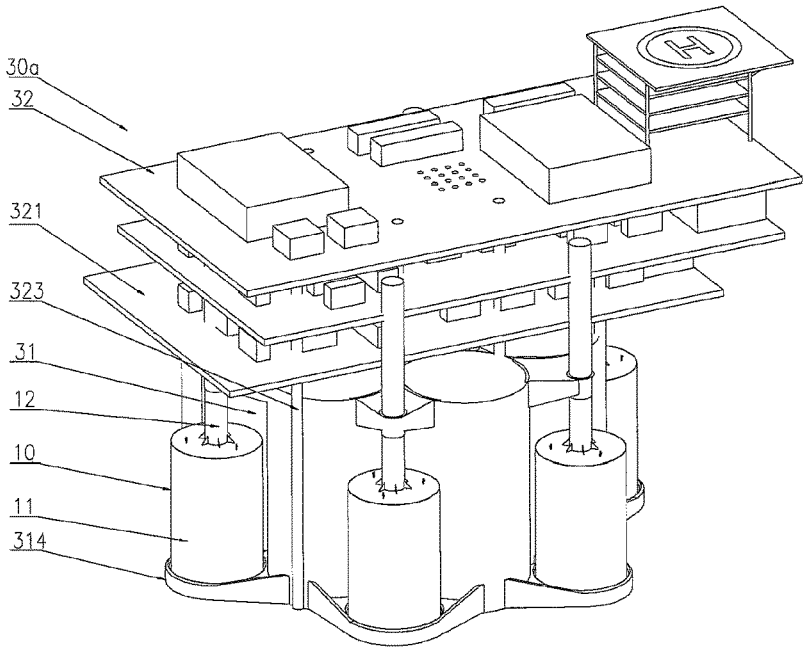
FIG. 6 is an isometric view of implementation plan A, a removable sit-on-bottom offshore platform which has a storage tank with above-water top in construction or towing conditions.
Figure 7:
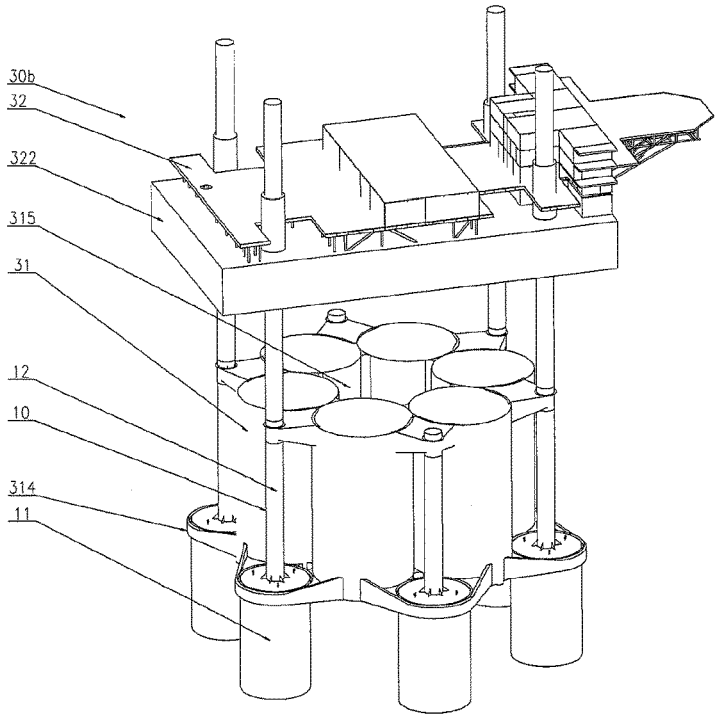
FIG. 7 is an isometric view of implementation plan B, a removable sit-on-bottom offshore platform which has a storage tank with underwater top in in-place condition.
Figure 8:
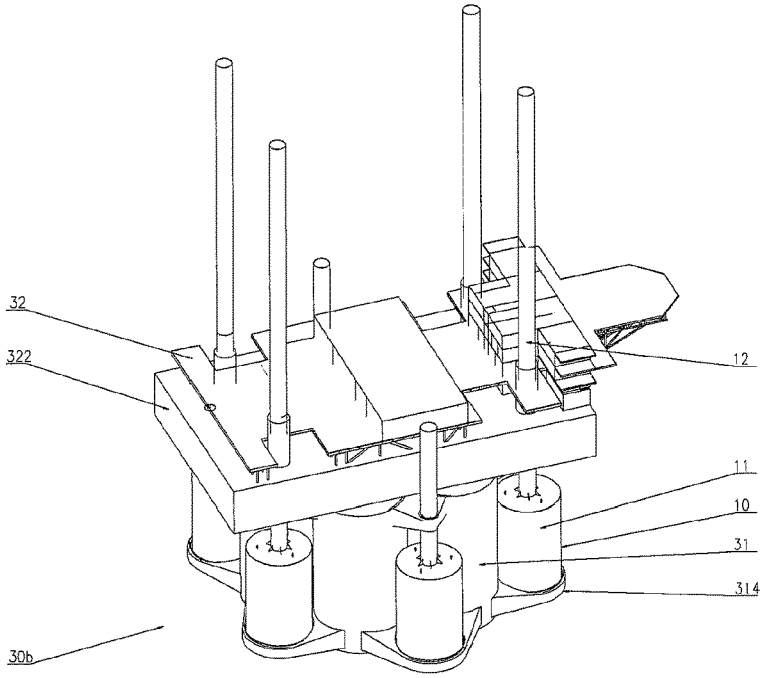
FIG. 8 an isometric view of implementation plan B, a removable sit-on-bottom offshore platform which has a storage tank with underwater top in construction or towing conditions.

As shown in FIGS. 4~8, as another application of the suction leg 10 in the present application, this embodiment provides a removable sit-on-bottom offshore platform 30 for the development of offshore oil and gas fields, drilling, oil and gas production, natural gas liquefaction and regasification, natural gas chemical industry and liquid storage, as well as oily wastewater treatment. The removable sit-on-bottom offshore platform 30 in this embodiment has two types: one is removable sit-on-bottom offshore platform which has a storage tank with above-water top 30*a* as shown in FIGS. 4~6, referring to three conditions of in-place, construction and towing respectively; the other one is removable sit-on-bottom offshore platform which has a storage tank with underwater top 30*b* as shown in FIGS. 7 and 8, referring to the conditions of in-place, construction and towing.

The removable sit-on-bottom offshore platform 30*a* and 30*b* all have a storage tank 31, suction legs 10 and a topsides 32, as described below.

The storage tank 31 sit on the seabed 2, which is used to store platform-produced liquid or receive input liquid. A transparent moon pool 315 may be or not set in the storage tank. There are at least two pile sleeves 314 around the bottom parameter of storage tank 31 and they are connected and fixed together to form an integral structure.

The suction legs 10 as described above, the number of suction legs is equal to the number of the pile sleeves 314. Each suction leg 10 can have a long pole 12 or not. Each sealing long pile 11 of the suction leg 10 inserted into a pile sleeve 314 can slide up and down and be fixed to the pile sleeve 314.

The topsides 32 located in the top of storage tank 31 and above water 1, which comprises one or two or more kinds of facilities required for drilling, oil and gas production, storage and transportation, utilities and living, as well as open deck structures 321 (as shown in FIGS. 4~6) or box watertight deck structures 322 (as shown in FIGS. 7 and 8). The topsides 32 is connected to the storage tank 31 by deck legs 323, or connected to the long pole of the suction leg 12 directly. Similar to the long pole 12, the deck leg 323 is cylindrical or triangle truss structure.

As shown in FIGS. 4~6, the top of storage tank 31 is above water surface 1 to form a removable sit-on-bottom offshore platform with above-water top 30*a*, and a moon pool 315 is set at the center of storage tank. Each suction leg 10 has a long pole 12, and the long pole 12 is fixed on the top of storage tank 31 in addition to the connection between the sealing long pile 11 and the pile sleeve 314. The topsides structure 32 is multilayer open deck structure 321 (layer number is not limited to three as shown in FIGS. 4 and 5) which is fixed to the storage tank 31 by deck legs 323 (number of legs is not limited to eight as shown in FIGS. 4 and 5). Each deck leg 323 is cylindrical structure. This platform 30*a* is suitable for shallow waters, can be removed and reused if the water depth varies little. In order to suit the change of water depth and to avoid green water up to the lower deck of the platform, the topsides structure 32 may be designed sliding up-and-down and then fixed. If no need to remove, the topsides structure 32 can be fixed to the deck legs 323 directly.

As shown in FIGS. 7 and 8, the top of storage tank 31 is under water surface 1 to form a removable sit-on-bottom offshore platform with underwater top 30*b*, and a moon pool 315 is set at the center of storage tank. Each suction leg 10 has a long pole 12 or not. For the suction leg with long pole, the long pole 12 can be fixed to the top of storage tank 31 in addition to the connection between the sealing long pile 11 and the pile sleeve 314. For the suction leg without long pole, only the sealing long pile 11 can be fixed to the platform pile sleeves 314. The structure of topsides 32 is box watertight deck structure 322 which has at least one top seawater ballast compartment. In order to adapt the change in water depth, the deck structure 322 can slid up and down along the deck legs 323 and then fixed (not shown in the figure). As another embodiment, the deck legs 323 could be cancelled and replaced by the long poles 12, so the topsides structure 322 slid up and down along the long poles 12 and then fixed (as shown in FIGS. 7 and 8). This removable sit-on-bottom offshore platform with underwater storage tank 30*b* can removed and reused in water within 200 meters deep.

The storage tank 31 in this embodiment is steel structure or concrete structure or composite structure of both. Concrete structure including reinforced concrete structure, bi-steel concrete structure, fiber concrete structure and other existing concrete structures.

The long poles 12 and the deck legs 323 are cylindrical or triangle truss structure (not shown in FIG. 4~8), and the triangle truss structure is recommended for the removable sit-on-bottom offshore platform with underwater storage tank 30*b*.

During the process of construction in a dry dock and wet towing, each sealing long pile 11 of the suction leg 10 are raised and inserted in a pile sleeve 314, the bottoms of sealing long pile 11 and storage tank 31 are at the same horizontal plane (in other words, the suction legs 10 at the lifting position) and then fixed temporarily (as shown in FIGS. 6 and 8). During wet towing, all openings on the head of the sealing long piles 11 are closed, the bottom opening of each sealing long pile 11 submerges underwater to form an inside closed air column like a "buoyancy tank", which will increase the platform's buoyancy and GM (metacentric height) value needed for the stability during wet-towing. The closed air column is highly significant for a platform 30 with concrete storage tank 31.

The sealing long pile 11 is used for the removable sit-on-bottom offshore platform 30 as a foundation in this embodiment, at the same time, the weight of the platform also could be used as an auxiliary gravity foundation. Similar to the existing self-elevating platform, the suction legs 10 of this platform can be inserted into or pulled out from the seabed to make its storage tank 31 be sit on bottom and fixed to the seabed, or re-floated and removed.

The main process of offshore installation (inserting pile) of this platform 30*a* in present invention is as follows:

a. Towing the platform 30*a* to sea site.

b. Dropping anchor, adjusting and tensioning the anchor cables for positioning.

c. Opening all the openings on the heads of the sealing long piles for air releasing and water coming in.

d. Relieving the temporary fixing connections between the suction legs 10 and the platform storage tank 31.

e. Putting the suction legs 10 down relied on self-weight, inserting the sealing long piles 11 into mud.

f. Using the "gravity penetration method" or/and the "suction pile penetration method" (all head openings of the sealing long piles 11 have to be closed when using suction pile penetration method) to penetrate the sealing long pile 11 into the seabed and make the platform sit on the seabed.

g. If a one-time pile penetrating cannot reach the design depth, it has to remove the fixing connections, discharge ballast water, make the storage tank 31 re-floating from the seabed, and then use the "gravity penetration method" or/and the "suction pile penetration method" again, until it reaches the design depth.

h. Closing all head openings of the sealing long piles 11, then the offshore installation is finished.

Each sealing long pile 11 bears loads as a suction pile does. Large offshore construction facilities are not required during the entire process which means "self-installation".

The main process of offshore installation (inserting pile) of this platform 30*b* in present embodiment is as follows.

a. Putting the topsides down to make the box watertight deck structure 322 sit on the top of the storage tank 31 before the platform towing.

b. Towing the platform 30*b* to sea site.

c. Dropping anchor, adjusting and tensioning the anchor cable to fixed position.

d. Opening all the openings at the heads of the sealing long piles 11 to make air releasing and water coming in.

e. Relieving the temporary fixing connections between the suction leg 10 and the deck 322 and between the suction leg 10 and the platform storage tank 31 at the same time.

f. Putting the suction leg 10 down relied on self-weight to a setting depth (determined by the depth needed for the sealing long pile 11).

g. Fixing the sealing long piles 11 to the storage tank 31 again.

h. Ballasting water into the storage tank 31 until the watertight deck 322 in floating condition.

i. Continuously ballasting water into the storage tank 31 to its highest level to make the sealing long piles 11 inserted into seabed 2 as deep as possible.

j. Lifting watertight the deck 322 to a setting height, fixing the long pole 12 or fixing the deck leg 323 to the deck 322 again.

k. Ballasting water into the top seawater ballast compartment of the deck 322, using the "gravity penetration method" or/and the "suction pile penetration method" (the openings of the sealing long piles have to be closed when using suction pile penetration method) to penetrate the pile into seabed and make the storage tank sit on the seabed.

l. Closing all head openings of the sealing long piles 11, then the offshore installation is finished.

Each sealing long pile 11 bears loads as a suction pile does. Large offshore construction facilities are not required during the entire process which means "self-installation."

When the platform need to be relocated, the pile extracting is the inverse process of the pile inserting, using the "buoyancy uplift method" or/and the "suction pile uplift method" to complete the pile extracting and make the storage tank re-floated again and then remove platform. The said process, which does not require large offshore construction facilities and means "self-removal", is the inverse one of pile inserting mentioned above and no need to be repeated here.

Various forms and structures of the storage tank 31 of the removable sit-on-bottom offshore platform are provided in the present application, including but not limited to single-cylinder form, multi-cylinder form and rectangular box form made of steel structure or concrete structure. The functions of the storage tank are as: being support for the topsides 32, providing storage for liquids produced by the platform or received outside, providing gravity for pile inserting, and providing buoyancy for construction, towing and pile extracting. The storage tank 31 comprises at least one liquid storage compartment and one seawater ballast compartment for displacement between the stored liquid and the ballast seawater in equal or unequal mass flow-rate, or only one liquid storage compartment without seawater ballast compartment. The storage tank 31 can has a moon pool to accommodate wellhead conductors and risers.

Figure 9:
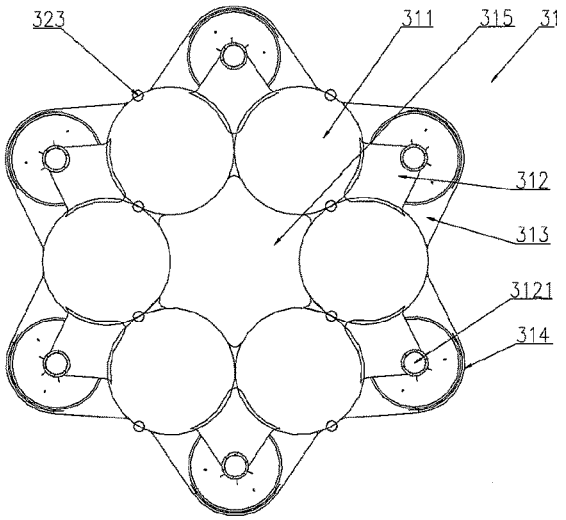
FIG. 9 is a plane view of storage tank sit on the seabed.
Figure 10:
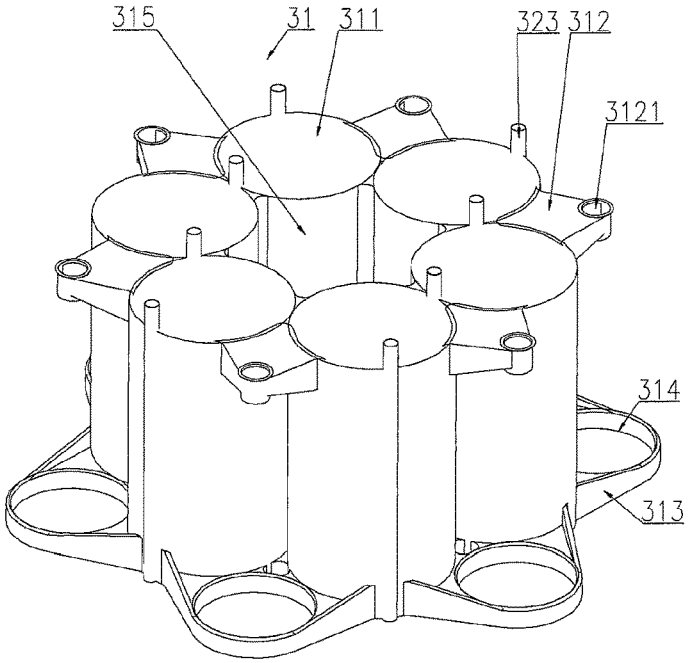
FIG. 10 is an isometric view of storage tank sit on the seabed.

As shown in FIGS. 9 and 10, the sit-on-bottom storage tank 31 is preferably cylinder-shaped tank group. The said tank group consists of a body which is formed by multi closely connected vertical tank units in an honeycomb form or a single vertical tank unit, a top connection structure 312 and a bottom connection structure 313 surrounding the top and the bottom of the body respectively. The function of top connection structure 312 and bottom connection structure 313 is to connect the suction legs 10 and the storage tank 31 together, to make the suction legs 10 can slip up and down along the storage tank 31 and then fixed. The pile sleeves 314 are located at the bottom around the storage tank 31, and each pile sleeve 314 is tangent to the single vertical cylindrical tank unit 311 or to the two adjacent tank units 311 of the cylinder-shaped tank group becoming a part of bottom connection structure 313. At the intersection of the top connection structure 312 with each vertical central axis of pile sleeve 314, there is a hole 3121 for the long pole 12 traverse and fixation, or if the suction leg 10 has no long pole for the platform 30*b*, there is a hole with same diameter as the inside diameter of the pile sleeve 314 (not shown in FIGS. 9 and 10) for the sealing long pile 11 traverse and fixation, or a mooring rope which can raise and lower the sealing long pile 11 (not shown in FIGS. 9 and 10).

The said tank units 311 can be used for storing one or many different liquids. As shown in FIGS. 9 and 10 as an example, six tank units 311 are formed a tank group, i.e., the storage tank, in single layer, with a hollow on the center and arranged in regular hexagon, and its center part is a transparent moon pool 315 to accommodate wellhead's conductor. In case no conductor is required, the moon pool 315 can be replaced by an additional tank unit 311 at the center, so the seven tank units 311 in total are in two layers. The moon pool 315 can also be arranged in other place of the tank group. The number and arrangement of the tank units 311 should not be limited as shown FIGS. 9 and 10. Nineteen tank units in three layers and arranged in regular hexagon, or more tank units in multilayer and arranged in circular, rectangle and long hexagon to form a storage tank are examples based on FIGS. 9 and 10. Another example, for the platforms 30*b* which underwater storage tank needs to store large amounts of liquids, the storage tank could be formed by 12, 18 or 24 tank units in three rows with each of 4, 6 or 8 tank units, and arranged in long hexagon with a central moon pool. As another example, for LNG (liquefied natural gas) receiving and regasification terminals located in shore waters, the storage tank could be a multilayer cylindrical tank group with above-water top, which tank units are in forms of regular hexagon or multiple hexagons arrange in interval or a long hexagon for LNG storage. The number and arrangement of the suction legs 10 matched with the storage tank is determined as per the environmental loads on the platform 30 and the geological conditions of the seabed.

The tank unit 311 of the storage tank has different structural forms as per its-stored liquid, which comprises four types: 1) tank unit with single-wall made of reinforced concrete or steel as oily water compartment, which is used to deal with oily water by thermochemical settlement or bacterial biochemical treatment, 2) tank unit with steel plate and concrete composite structure 33 provided by this application, which is used to store various kinds of industrial liquid products, 3) vertical cylindrical multi-tank, which is addressed in this inventor's U.S. patent document U.S. Pat. No. 8,292,546B, which is incorporated herein by reference, 4) vertical tank unit with steel plate and concrete composite structure, which is addressed in this inventor's application of PCT/CN2013/070808 dated Jan. 22, 2013, which also incorporated herein by reference. The structural forms of tank units 311 of the storage tank could be only one or more of the said four types at the same time as per the function of the platform 30.

Figure 11:
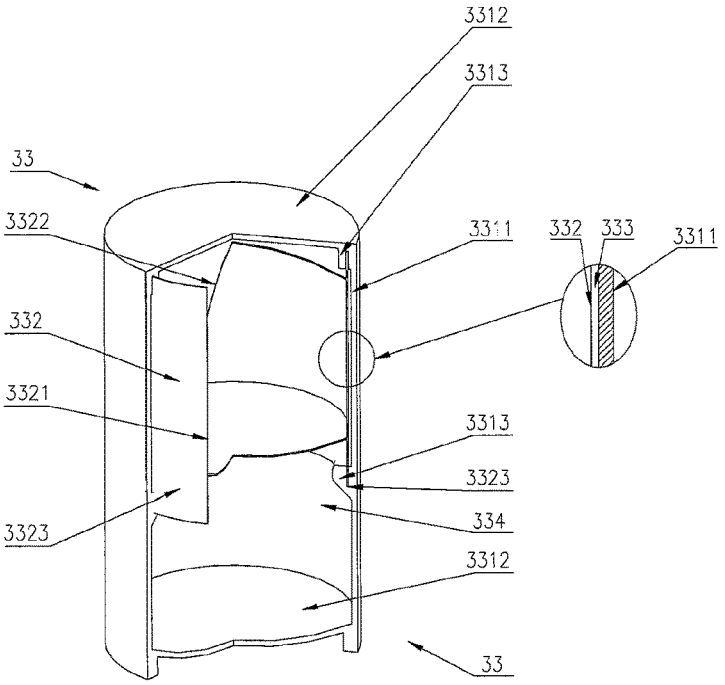
Figure 12:
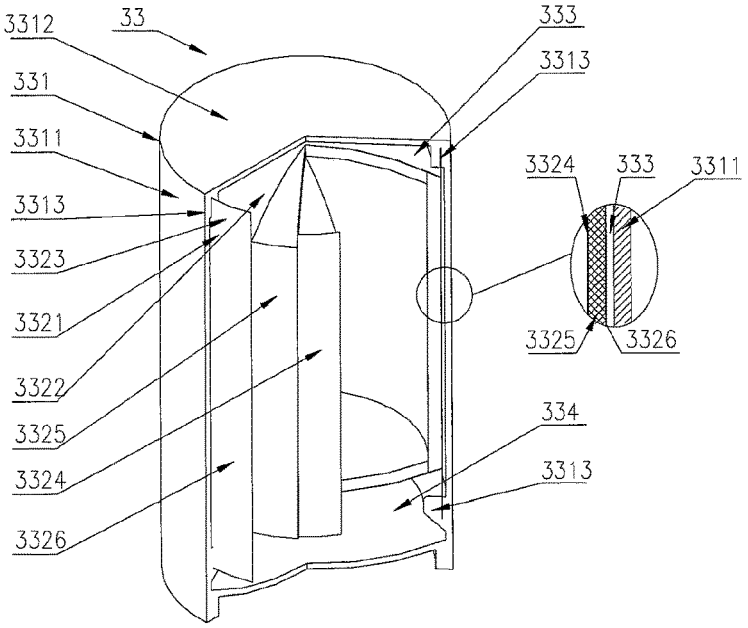
FIG. 12 is an isometric view of tank unit with steel plate and concrete composite structure for storing liquefied natural gas.

As shown in FIGS. 11 and 12, the tank unit with steel plate and concrete composite structure 33 provided by this embodiment comprises an outer cylindrical concrete tank 331, an inner cylindrical steel tank 332 and an isolation layer 333. The outer cylindrical concrete tank 331 comprises an outer tank shell 3311, two heads 3312 at both ends and two ring corbels 3313 at inner side of the outer tank shell 3311. Of the two ring corbels 3313, one is at the top of the outer tank shell 3311, the other one is at the bottom, or as shown in FIGS. 11 and 12, one is at the top, the other one is at the middle position, or both are at other two locations at intervals. The inner cylindrical steel tank 332 comprises an inner tank shell 3321, two heads 3322 with two epitaxial structures 3323 at both ends of the inner tank shell 3321. Each epitaxial structure 3323 is connected to a ring corbel 3313 in two connection types: connections of both two ends are fixed as the first, or one end is fixed and the other is sliding as the second. The outer cylindrical concrete tank 331 and the inner cylindrical steel tank 332 will not contact to each other except for the said connections and so there are some gaps or spaces in-between. The gap between the outer tank shell 3311 and the inner tank shell 3321 and the relatively small space between the outer tank head 3312 and the inner tank head 3322 are defined as the isolation layer 333 which are filled in an isolation medium. The relatively large space between the outer tank head 3312 and the inner tank head 3322 are defined as spare compartment 334. As shown in FIGS. 11 and 12, the gap between the outer tank shell 3311 and the inner tank shell 3321 and the space between the top heads of the outer tank and the inner tank are the isolation layer 333, and the space between the bottom heads of the outer tank and the inner tank as shown is the spare compartment 334. The outer cylindrical concrete tank 331, the inner cylindrical steel tank 332, the isolation area 333 and the spare compartment 334 become an integrated structure through the said connections.

The spare compartment 314 of the tank unit with steel plate and concrete composite structure 33 to be used as seawater ballast compartment can be made of concrete. The pressure inside the tank unit with steel plate and concrete composite structure 33 should not be so high, usually just above atmospheric pressure 1~2 bar.

As shown in FIG. 11, the tank unit with steel plate and concrete composite structure 33 is used to store crude oil, condensate oil, liquefied petroleum gas (LPG) and etc., wherein the inner steel tank 332 with single wall is located in upper position inside the outer cylindrical concrete tank 331, the isolation layers 333 in-between are filled in a nitrogen and the spare compartment 334 in-between is used as a seawater ballast compartment; during operation of the platform, the stored liquid and the ballast seawater can be displaced in an equal or unequal mass flow rate. When the inner steel tank 332 is bearing high pressure or high temperature, one end of the epitaxial structure 3323 (bottom is the preference) is fixedly connected to the middle ring corbel of the outer cylindrical concrete tank 3313, the other end is sliding-connected to the top ring corbel 3313. When the inner steel tank 332 is bearing low pressure or small temperature rising, one end of the epitaxial structure 3323 (bottom is the preference) is fixedly connected to the middle ring corbel of the outer cylindrical concrete tank 3313, the other end is sliding-connected to the top ring corbel 3313, or both ends of the epitaxial structure are fixedly connected to the two ring corbels of outer cylindrical concrete tank 3313. Because the storage pressure of liquefied petroleum gas (LPG) under normal temperature is about 15 atmospheres, one end of the connection of the inner steel tank 322 for LPG shall be fixed and the other, sliding.

During the storage and transportation process, crude oil, liquid at normal pressure and temperature and LPG could be displaced with ballast seawater in an equal or unequal mass flow rate. If the equal mass flow rate selected, the technologies of "displacement system between stored liquid and ballast seawater in an equal mass flow rate" and "sit-on-bottom with small underwater weight" as described in U.S. Pat. No. 8,292,546 B2, and "displacement system between LPG and ballast seawater in an equal mass flow rate" as described in d U.S. Pat. No. 8,678,711 B2 are recommended. U.S. Pat. Nos. 8,292,546 B2 and 8,678,711 B2 are herein incorporated by reference.

As shown in FIG. 12, the tank unit with steel plate and concrete composite structure 33 is used to store liquefied natural gas (LNG) or liquids at ultralow temperature, wherein the inner steel tank 332 with multi-wall is located in upper position inside the outer concrete tank 331, the multi-wall contains, from inside to outside, steel plate to resist ultra-low temperature with low coefficient of linear expansion (LNG compartment wall 3324), thermal insulation layer 3325 and outer steel plate (inner tank's outer steel wall 3326), the isolation layers 333 between the inner steel tank 332 and the outer concrete tank 331 are filled in a nitrogen and the spare compartment 334 is used as a seawater ballast compartment. One end of the epitaxial structure 3323 (bottom is the preference) is fixedly connected to the middle ring corbel of the outer cylindrical concrete tank 3313, the other end is sliding-connected to the top ring corbel 3313, or both ends of the epitaxial structure are fixedly connected. During the storage and transportation process of LNG, LNG and ballast seawater can displaced in equal or unequal mass flow rate. If equal mass flow rate selected, the technologies of "sit-on-bottom with small underwater weight" as described in U.S. Pat. No. 8,292,546 B2, and "displacement system between LNG and ballast seawater in equal mass flow rate" as described in U.S. Pat. No. 8,678,711 B2 are recommended.

The removable sit-on-bottom offshore platform in the present application has a wide range of uses, and based on the storage tank selected, it can form different platforms with different functions.

The removable sit-on-bottom offshore platform 30*a*, which has a storage tank 31 with above-water top, is used for oil and gas field development (see FIGS. 4, 5 and 6) and suitable for shallow waters with depths no more than 50 meters. The said storage tank 31 is preferably multi-cylinder-shaped tank group in a regular hexagon form, and a moon pool 315 is set in the center of the storage tank if drilling or wellheads is required (see FIGS. 9 and 10). A berthing structure for shuttle tanker is set at one side of storage tank 31 near water surface (not shown in the figure), so that the stored liquids can be transported to a shuttle tanker. The number of the tank units within the cylindrical tank group shall be determined by the amount of the platform-produced liquid, large amount, more number of the tank units. The structural type of the tank units being formed the cylindrical tank group (storage tank) can be determined by the categories of the platform-produced liquids. For example, if all tank units 311 of the storage tank as shown in FIG. 11 to store crude oil, the platform will become a crude oil production, storage and transport platform (replace the existing fixed platform and FPSO at the same time). As another example, if all the tank units 311 as shown in FIG. 12 to store LNG, the platform will become a LNG production, storage and transport platform. In addition to production of crude oil, if the platform 30*a* is for recycling associated gas of LNG, LPG and the condensate oil, the tank units could be different types to store crude oil, LNG, LPG and the condensate oil; or if oily water treatment requires a large tank capacity, the tank units could be tank units with single wall for oily water sedimentation; and so the platform 30*a* will become a multi-function integrated platform.

The removable sit-on-bottom offshore platform 30*b*, which has a storage tank 31 with underwater top, is used for oil and gas field development (see FIGS. 7 and 8) and suitable for waters with depths between 40~200 meters. The said storage tank 31 is preferably multi-cylinder-shaped tank group in regular hexagon form (see FIGS. 9 and 10), or long hexagon form, and a moon pool 315 is set in the center of the storage tank. In order to achieve transmission of crude oil etc., two sets or evenly distributed three sets of fan-shaped rotated single point mooring/offloading system are installed on the platform (not shown in the figure) to offload the stored liquid to a shuttle tanker. Each fan-shaped rotated single point mooring/offloading system comprises a mooring winch and a floating hose drum, which are installed on the deck of the topsides 10. The mooring hawser from the winch goes down to and through the fairlead at the top of the storage tank 31, then out of the water and to connect the shuttle tanker. The shuttle tank will rotate to the fairlead as the center within a 240° sector under weathervane effect by the wind, current and wave, if the hawser keeping tension. In case the rotation of the shuttle tank beyond the 240°, the shuttle tanker has to be disconnected. The floating hose of the drum is used to transport the stored liquid from the platform to the shuttle tanker. The mooring winch can be cancelled if the shuttle tanker with DP system. A side berthing structure is needed to transport LNG and LPG (not shown in the figure). The number of the tank units within the cylindrical-tank group shall be determined by the amount of the platform-produced liquid, large amount, more number of the tank units. The structural type of the tank units being formed the cylindrical-tank group (storage tank) can be determined by the categories of the platform-produced liquids. For example, if all tank units 311 of the storage tank as shown in FIG. 11 to store crude oil, the platform will become a crude oil production, storage and transport platform (replace the existing fixed platform and FPSO at the same time). As another example, if all the tank units 311 as shown in FIG. 12 to store LNG, the platform will become a LNG production, storage and transport platform. In addition to production of crude oil, if the platform 30*b* is for recycling associated gas of LNG, LPG and the condensate oil, the tank units could be different types to store crude oil, LNG, LPG and the condensate oil; or if oily water treatment requires a large tank capacity, the tank units could be tank units with single wall for oily water sedimentation; and so the platform 30*b* will become a multi-function integrated platform.

As an application of the platform 30*a*, this embodiment provides a LNG receiving and regasification terminal which is located in shore waters. The storage tank of this terminal could preferably be one or multiple multilayer cylindrical-tank groups with above-water top and the multiple tank groups with a space to each other, and the tank units within each tank group are arranged in forms of a regular hexagon or a long hexagon as LNG storage tank 31 without moon pool. All the tank units within the said storage tank are steel plate and concrete composite structure 33 suitable to store LNG. The cylindrical-tank group arranged in a regular hexagon of the terminal is as shown in FIGS. 9 and 10, wherein the moon pool is replaced by a central tank unit. A berthing structure is installed at one side of the storage tank 31 near water surface as LNG carrier's dock (not shown in the figure). The topsides 32 is installed on and fixed to the top of the storage tank 31 through deck legs 323, and the topsides accommodates facilities like process equipment and utilities for LNG reception, transshipment and vaporization. The sealing long piles 11 are used for this terminal as a foundation in this embodiment, at the same time, an auxiliary gravity foundation in addition to the sealing long piles also could be used. Because the freeboard of the storage tank 31 of the platform is higher, its operation weight will be far greater than its displacement that will provide a required great gravity for the foundation.

The processes of storage and transportation of the platforms 30*a* & *b* and the terminal preferably adopt a displacement system between the stored liquids and ballast seawater in equal mass flow rate. The technology of "displacement system between stored liquid and ballast seawater in equal mass flow rate" as described in U.S. Pat. No. 8,292,546 B2 is recommended for crude oil and liquids with normal temperature. The technology of "displacement system between LPG/LNG and ballast seawater in equal mass flow rate" as described in U.S. Pat. No. 8,678,711 B2 is recommended for LPG and LNG For the platform 30*a* with foundations of the sealing long piles than gravity, the technology of "sit-on-bottom with small underwater weight" as described in U.S. Pat. No. 8,292,546 B2 is also recommended.

As an application of the platform 30*a*, this embodiment provides an oily water treatment and reinjection platform as shown in FIGS. 4 and 5, which is suitable for a water depth usually no more than 50 meters. Its storage tank 31 is preferred cylindrical-tank group arranged in regular hexagon (see FIGS. 9 and 10) without moon pool. It is well known that the treatment of high viscosity and heavy crude's oily water is very difficult, and special thermochemical settlement or bacterial biochemical process may have to be used, which requires a long residence time. For example, bacterial biochemical process often need a stay-time of 12 hours, so the platform has to provide a very large volume of the sedimentation compartments. All the tank units 311 of cylindrical-tank group of this platform are single wall tanks made of reinforced concrete or steel as oily water sedimentation compartments. The inlet oily water, and the outlet treated water can keep dynamic balance in the tank units to meet the demand of oily water treatment and reinjection. The topsides 32 is installed on and fixed to the top of the storage tank 31 through deck legs, and the topsides accommodates facilities like process equipment and utilities for oily water treatment and reinjection. The sealing long piles 11 are used for this platform 30*a* as a foundation, at the same time, an auxiliary gravity foundation in addition to the sealing long pile also could be used. The storage tank 31 of this platform is fully filled in water, without seawater ballast compartment and no need of displacement, which will provide a great operation weight required for the gravity foundation.

The removable sit-on-bottom offshore platform in the present application provides a new type of surface facilities with multifunction in one, and a new mode to develop offshore oil and gas fields with a water depth within 200 meters. The multi functions include drilling, oil and gas production, storage and transportation, oily water treatment, natural gas liquefaction and re-gasification. The platform in this application also has series of advantages, such as eco-friendly, safe and reliable. All the construction and commissioning work of the entire platform can be completed in a shipyard to achieve self-installation and self-relocation and reuse, significant savings of construction costs, production operations costs and decommissioning costs.

The specific embodiments described in this invention are only used to explain the purpose of the invention to provide a better understanding, and could not be interpreted as limitations to the invention in any way. In particular, various features in different embodiments described herein could be combined mutually and arbitrarily combination to form other implementation methods; unless there was a clear contrast description, these features should be understood as can be applied to any one embodiment, not limited to the embodiments described herein.

What is claimed is:

1. A suction leg, comprising:

a sealing long pile with a long pole, wherein the sealing long pile comprises a tubular pipe and a top head connected tightly to the tubular pipe to form a cylindrical integral structure with a sealing top and an opening bottom, wherein the top head has at least one opening to be opened or closed, wherein the long pole is a cylindrical or a triangle truss structure being fixed on a center of the top head of the sealing long pile and has a common axis with the sealing long pile, wherein a diameter of the long pole is smaller than a diameter of the tubular pipe, wherein the sealing long pile is penetrated into a seabed by one or more of: a gravity penetration method or a suction pile penetration method, or pulled out from the seabed by one or more of: a buoyancy uplift method or a suction pile uplift method;

wherein the sealing long pile slides up and down along or is fixed with a pile sleeve, wherein the sealing long pile serves as a foundation of an offshore caisson, wherein at an intersection of the top connection with each vertical central axis of the pile sleeve, there is a hole for traverse and fixation of the long pole, or a hole with a diameter equal to a diameter of the sealing long pile for traverse and temporary fixation of the sealing long pile if the suction leg has no long pole.

2. The suction leg as described in claim 1, further comprising a group of valves installed on the at least one opening on the top head to open or close the at least one opening on the top head, wherein the group of valves comprises one or more of: an air release, a suction valve, an air intake valve, or a water intake valve.

3. An offshore caisson, comprising:

a watertight tank made of steel or reinforced concrete structure, wherein the watertight tank has at least one ballast compartment used for injecting or ejecting ballast seawater and a solid ballast to change a weight of the offshore caisson wherein the watertight tank is a cylindrical tank group, wherein the cylindrical tank group comprises a body formed by multi closely connected tank units in a honeycomb form or a single tank unit, and a top connection structure and a bottom connection structure surrounding the top and bottom of the body respectively;

at least two pile sleeves arranged symmetrically around a bottom of the watertight tank, wherein the watertight tank and the pile sleeves are connected together via a bottom connection that surrounds the bottom of the watertight tank and is tangent to the watertight tank and a top connection, wherein the pile sleeves are part of the bottom connection wherein each pile sleeve as part of the bottom connection structure is tangent to the single tank unit or two adjacent tank units in the honeycomb form, wherein at an intersection of the top connection structure with each vertical central axis of the pile sleeve, there is a hole for traverse and fixation of a long pole, or a hole with a diameter equal to a diameter of a sealing long pile for traverse and temporary fixation of the sealing long pile if a suction leg has no long pole, or there is a mooring rope which raises and lowers the sealing long pile; and suction legs in the pile sleeves, wherein the suction leg with or without a long pole comprises a sealing long pile having a tubular pipe and a top head connected tightly to the tubular pipe to form a cylindrical integral structure with a sealing top and an opening bottom, wherein the sealing long pile of the suction leg slides up and down along or is fixed with the pile sleeve, wherein the sealing long pile serves as a foundation of the offshore caisson.

4. The offshore caisson as described in claim 3, further comprises a skirt guard panel being installed around the bottom of the watertight tank, wherein the skirt guard panel is penetrated into or pulled out from a seabed by gravity or buoyancy of the offshore caisson.

5. A sit-on-bottom offshore platform, comprising:

a storage tank sitting on a seabed for storing platform-produced liquid or receiving input liquid and with or without a transparent moon pool, wherein at least two pile sleeves are arranged symmetrically around the bottom of the storage tank, the pile sleeves being connected to the storage tank to form an integral structure;

suction legs comprising sealing long piles with or without long poles, the sealing long pile having a tubular pipe and a top head connected tightly to the tubular pipe to form a cylindrical integral structure with a sealing top and an opening bottom, the top head having an opening, wherein a number of the suction legs is equal to a number of the pile sleeves, wherein the sealing long piles of the suction legs are inserted into the pile sleeves, and slide up and down or are fixed to the pile sleeves; and a topsides located in a top of the storage tank, wherein the topsides is connected to the storage tank by deck legs or the long poles of the suction legs, wherein each suction leg is raised up at its upper position, bottoms of each sealing long pile and the storage tank are at a same horizontal plane, wherein the opening on the top head of the sealing long pile is closed during construction and towing, wherein the opening bottom of each sealing long pile is submerged underwater to form an enclosure for air inside the sealing long pile to increase buoyancy and metacentric height of the sit-on-bottom offshore platform during wet towing;

wherein the sealing long piles of the suction legs are pressed down into the seabed and become a foundation of the sit-on-bottom offshore platform, wherein when the opening of the top head is open, the sit-on-bottom offshore platform sits on the seabed through a gravity penetration method or a suction pile penetration method and is re-floated or removed through a buoyancy uplift method or a suction pile uplift method, wherein when the opening of the top head is closed, the sit-on-bottom offshore platform sits on the seabed through the suction pile penetration method and is re-floated or removed through the suction pile uplift method, wherein the storage tank is a cylindrical tank group, wherein the cylindrical tank group comprises a body formed by multi closely connected tank units in a honeycomb form or a single tank unit, and a top connection structure and a bottom connection structure surrounding the top and bottom of the body respectively, wherein each pile sleeve as part of the bottom connection structure is tangent to the single tank unit or two adjacent tank units in the honeycomb form, wherein at an intersection of the top connection structure with each vertical central axis of the pile sleeve, there is a hole for traverse and fixation of the long pole, or a hole with a diameter equal to a diameter of the sealing long pile for traverse and temporary fixation of the sealing long pile if the suction leg has no long pole, or there is a mooring rope which raises and lowers the sealing long pile.

6. The sit-on-bottom offshore platform as described in claim 5, wherein the tank unit is a reinforced concrete or steel vessel with a single wall, or a storage tank with a multi-wall of steel plate and concrete composite structure which includes:

a vertical outer cylindrical concrete tank comprising an outer tank shell, two heads at both ends of the outer tank shell, and two ring corbels at inside of the outer tank shell, one ring corbel being at a top of the outer tank shell, the other ring corbel being at a bottom of the outer tank shell, or one ring corbel being at the top of the outer tank shell, the other ring corbel being at a middle position of the outer tank shell, or both ring corbel being at other two locations between the top and bottom of the outer tank shell;

a vertical inner cylindrical steel tank comprising an inner tank shell, and two heads and epitaxial structures at both ends of the inner tank shell, wherein the two epitaxial structures are connected to the ring corbels in two connection types: both two ends fixed, or one fixed and the other sliding, wherein among spaces between the outer tank shell and the inner tank shell, a relatively small space between the head of the outer tank shell and the head of the inner tank shell is an isolation layer which is filled in an isolation medium, and a relatively large space between the head of the vertical outer cylindrical concrete tank and the head of the vertical inner cylindrical steel tank is a spare compartment, and so that the vertical outer cylindrical concrete tank, the vertical inner cylindrical steel tank, the isolation layer and the spare compartment form an integrated structure.

7. The sit-on-bottom offshore platform as described in claim 6, wherein the vertical inner cylindrical steel tank with the single wall is a liquid storage compartment, and located at an upper part inside the vertical outer cylindrical concrete tank to store crude oil or liquids at normal pressure and temperature, wherein the isolation layer is filled in a nitrogen as the isolation medium and the spare compartment is used as a seawater ballast compartment.

8. The sit-on-bottom offshore platform as described in claim 6, wherein the vertical inner cylindrical steel tank with a multi-wall is located in an upper position inside the vertical outer cylindrical concrete tank to store liquefied natural gas or liquids at ultralow temperature, wherein the multi-wall contains, from inside to outside, a steel plate to resist ultra-low temperature with low coefficient of linear expansion, a thermal insulation layer, and an outer steel plate, wherein the isolation layer is filled in a nitrogen and the spare compartment is used as a seawater ballast compartment.

9. The sit-on-bottom offshore platform as described in claim 6, wherein the vertical inner cylindrical steel tank with the single wall is a liquid storage compartment, and located at an upper part inside the vertical outer cylindrical concrete tank to store Liquefied Petroleum Gas (LPG), wherein the two epitaxial structures are sliding-connected and fixedly connected to the ring corbel at the top of the outer tank shell and the ring corbel at the middle position of the outer tank shell respectively, wherein the isolation layer is filled in a nitrogen as the isolation medium and the spare compartment is used as a seawater ballast compartment.

10. The sit-on-bottom offshore platform as described in claim 5, wherein the top of the storage tank is above water to form a sit-on-bottom offshore platform with an above-water top, wherein the topsides has a multilayer open deck structure, which slides up and down along the decks legs and then is fixed at a designed elevation, or is permanently connected and fixed to the deck legs directly.

11. The sit-on-bottom offshore platform as described in claim 10, wherein the topsides is used for Liquefied Natural Gas (LNG) reception, transportation and vaporization, and the multilayer open deck structure of the topsides is fixedly connected to the deck legs, wherein the storage tank is a cylindrical tank group arranged in regular hexagon or long hexagon without a moon pool, wherein all tank units of the cylindrical tank group have steel plate and concrete composite structure and used to store LNG to adopt a displacement between the LNG and ballast seawater in equal mass flow rate, wherein a berthing structure for the LNG is set at one side of the cylindrical tank group near a water surface, and so that the sit-on-bottom offshore platform is a terminal of the LNG reception and vaporization in shore waters.

12. The sit-on-bottom offshore platform as described in claim 10, wherein the topsides is used for oily water treatment and reinjection, and the multilayer open deck structure of the topsides is fixedly connected to the deck legs, wherein the storage tank is a cylindrical tank group arranged in regular hexagon without a moon pool, wherein all tank units of the cylindrical tank group are single wall tanks made of reinforced concrete or steel as oily water sedimentation compartments, wherein an inlet of the oily water and an outlet of treated water keeps dynamic balance in the tank units for sewage treatment and reinjection.

13. The sit-on-bottom offshore platform as described in claim 5, wherein the top of the storage tank is under water to form a sit-on-bottom offshore platform with an underwater top, wherein the topsides has a box watertight deck structure which comprises at least one top seawater ballast compartment, wherein the box watertight deck structure is connected to the storage tank through the deck legs or the long poles of the suction legs, and slides up and down along the decks legs or the long poles, and then is fixed at a designed elevation.

14. The sit-on-bottom offshore platform as described in claim 5, further comprising an auxiliary gravity type foundation used for the sit-on-bottom offshore platform.

* * * * *